US006145160A

United States Patent [19]

Buss et al.

[11] Patent Number: 6,145,160

[45] Date of Patent: Nov. 14, 2000

[54] TANK-TYPE VACUUM CLEANER

[75] Inventors: Jeffrey Buss, Newport Beach, Calif.; Maureen E. Carroll, Atlanta, Ga.; David Scott Rowley, Powder Springs, Ga.; John A. McMillan, Atlanta, Ga.; Kirk Charles, Austell, Ga.

[73] Assignee: Primus Holdings, L.P., Dallas, Tex.

[21] Appl. No.: 09/197,126

[22] Filed: Nov. 20, 1998

[51] Int. Cl.[7] ..... A47L 5/36

[52] U.S. Cl. ..... 15/323; 15/327.2; 15/327.5

[58] Field of Search ..... 15/323, 327.2, 15/327.7, 350

[56] References Cited

U.S. PATENT DOCUMENTS

| | | | |
|---|---|---|---|
| 2,974,343 | 3/1961 | Seyfried | 15/323 |
| 3,142,857 | 8/1964 | Fresard et al. | 15/327.7 |
| 3,170,184 | 2/1965 | Jepson et al. | 15/323 |
| 3,466,696 | 9/1969 | Grellsson | 15/327.7 |
| 3,667,084 | 6/1972 | Valbona et al. | 15/323 |
| 3,708,962 | 1/1973 | Deguchi et al. | 15/327.7 X |
| 3,856,488 | 12/1974 | Kato et al. | 15/327.7 X |
| 4,658,465 | 4/1987 | Keane et al. | 15/323 |
| 4,763,382 | 8/1988 | Sumerau | 15/323 |
| 4,945,603 | 8/1990 | Herron | 15/323 |
| 5,014,385 | 5/1991 | Bradd et al. | 15/323 |
| 5,353,470 | 10/1994 | Bartlett | 15/327.7 X |
| 5,479,676 | 1/1996 | Martin et al. | 15/323 |
| 5,836,046 | 11/1998 | Huffman et al. | 15/323 X |

*Primary Examiner*—Chris K. Moore
*Attorney, Agent, or Firm*—Sidley & Austin

[57] ABSTRACT

A tank-type vacuum cleaner which utilizes cyclonic action includes a recessed power cord storage channel, integrally formed in a lower surface of vacuum cleaner housing, to store a power cord for the vacuum cleaner. The vacuum cleaner further includes an exhaust baffle to diffuse discharged air, muffle acoustic noise output, and protect an internalized outlet filter. The vacuum cleaner further includes both an improved motor mount system and an electrified inlet with an obstructing mechanism.

24 Claims, 2 Drawing Sheets

TANK-TYPE VACUUM CLEANER

FIELD OF THE INVENTION

The present invention relates to a tank-type vacuum cleaner, and in particular, to a tank-type vacuum cleaner having certain features to enable at least one of the following: optimized storage, improved safety, and reliable electrical connection between a vacuum body and its power accessories.

BACKGROUND OF THE INVENTION

The vacuum cleaner of the present invention is directed to a tank-type vacuum which is characterized by its use of cyclonic action to optimize its operation and performance. Examples of this type of vacuum cleaner are disclosed in U.S. Pat. Nos. 2,639,002 and 5,297,311. An explanatory description of the operation of these systems is provided below.

In general reference to FIG. 2, a tank-type vacuum cleaner has an inlet (for example, inlet 40) at a forward portion of the housing and which, whether directly or otherwise, enters a debris/dust collection receptacle (for example, bag 54) at an angle between approximately 10° and approximately 85°. This angle of entry requires inlet air to be forced against the wall of the receptacle (in reference to FIG. 2, see arrows). During operation, a continuous force is applied to the wall of the receptacle, thus preventing an accumulation of dust/debris at the wall adjacent to the vacuum motor assembly (for example, motor assembly M). Consequently, provided the collection receptacle maintains an appropriate level of dust/debris, a path between the air inlet and the motor assembly is largely uninterrupted or unobstructed. Other systems force air from an inlet through accumulated dust/debris. As more and more dust/debris accumulates, the vacuum cleaner motor must work harder to force an appropriate level of air through the system, thereby reducing efficiency and performance.

Conventional vacuum cleaner systems, whether tank-type or otherwise, consistently possess a number of shortcomings which inconvenience manufacturing, operation, use, or storage. An abbreviated description of at least a portion of such shortcomings is set forth below.

Conventional vacuum systems, whether tank-type or similarly constructed canister systems, typically have between 18 and 30 feet of power cord. When the vacuum cleaner is not in use, this length of cord can be quite burdensome to store. Common methods of storage include: wrapping the cord about the body of the vacuum, wrapping the cord about a cord wrap positioned on an upper surface of the vacuum, or using an automatic cord winder.

In regard to the first two alternatives, while also being aesthetically unappealing, these cord storage options may interfere with opening and closing compartments within and/or installing and removing components from the body of the vacuum. Automatic cord winders are relatively expensive and add considerable weight to a vacuum cleaner. Moreover, when an automatic cord winder is positioned on an underside of a vacuum cleaner, it typically increases the height of the canister/tank by several inches. The increased height of the canister/tank decreases the stability of conventional systems and increases the opportunity for such systems to tip over during use.

Conventional systems commonly do not include an adequate "downstream" air filtration system. Conventional vacuum systems instead rely upon a primary filter, for example, a disposable filter bag, and any downstream filter is limited to an open-cell foam or the like. While a filter bag may adequately remove particulates introduced into the vacuum, such filters do not address dust and the like added to air flowing through the vacuum, for example, by normal deterioration of a vacuum motor. The open-cell foams which are used are cosmetic in nature and offer no practical benefit in capturing fine particulates, controlling the exhaust, or muffling acoustic noise of the vacuum motor.

At least in the context of tank-type vacuums, these vacuums must typically be stored in a manner consistent with their use—resting on their wheels (or skids, as the case may be)—which limits different storage opportunities. Such limitation is due in part to the placement and orientation of the inlet relative to the device's collection receptacle. Specifically, conventional inlets allow inadvertent discharge of collected dust/debris when the system is stood on its forward end. As vacuums are typically stored more than they are used, a user evaluating different systems may place greater emphasis on their ability to easily store a vacuum cleaner as opposed to its quality or efficiency of operation.

SUMMARY OF THE INVENTION

The present invention is directed to a vacuum cleaner of varying embodiments. In one form or another, the present invention generally includes a housing with an inlet and an outlet. As to one particular embodiment, the housing may be formed of a first housing portion and a second housing portion, wherein the first portion mates with the second portion to define at least an motor mount within an interior of the housing. The vacuum cleaner further includes a particulate accumulation receptacle, removably positioned within the housing and between the inlet and the outlet, to filter particulates from air passing therethrough. To draw air into the housing, each of the embodiments include a vacuum motor having an impeller assembly, positioned within the housing and between the outlet and the particulate accumulation receptacle. A vacuum motor assembly, which includes an impeller protection screen that receives the vacuum motor, is engaged and retained by the motor mount within the housing.

The housing may further include a power cord storage channel recessed therein as well as an inlet closing device to selectively obstruct the inlet. The vacuum cleaner of the present invention may further include a removable outlet cover, substantially covering the outlet so as to establish at least one opening between the housing and the cover (for example, when the cover is joined to the housing). In particular regard to the relationship between the cover and the housing, a space is defined between the cover and the housing. The space is in communication with the outlet and provides a volume which may receive an outlet filter.

An object of the present invention is to overcome the limitations present within the conventional art.

Another object of the present invention is to provide a vacuum cleaner with a means to store a power cord which does not adversely affect the stability, weight, nor appearance thereof.

Another object of the present invention is to provide a vacuum cleaner having an improved motor mount which reduces assembly time and component expense.

Another object of the present invention is to provide a vacuum cleaner with a segregated exhaust which is muffled as well as diffused into the surrounding environment.

Another object of the present invention is to provide a tank-type vacuum cleaner a means of being placed on a forward end without inadvertent discharge of accumulated dust/debris.

Other objects and advantages of the present invention will be apparent to those of ordinary skill in the art having reference to the following Specification together with the drawings.

BRIEF DESCRIPTION OF THE DRAWINGS

In reference to the following figures, like reference numerals and letters indicate corresponding elements.

DETAILED DESCRIPTION OF THE PREFERRED EMBODIMENTS

Figure 1:
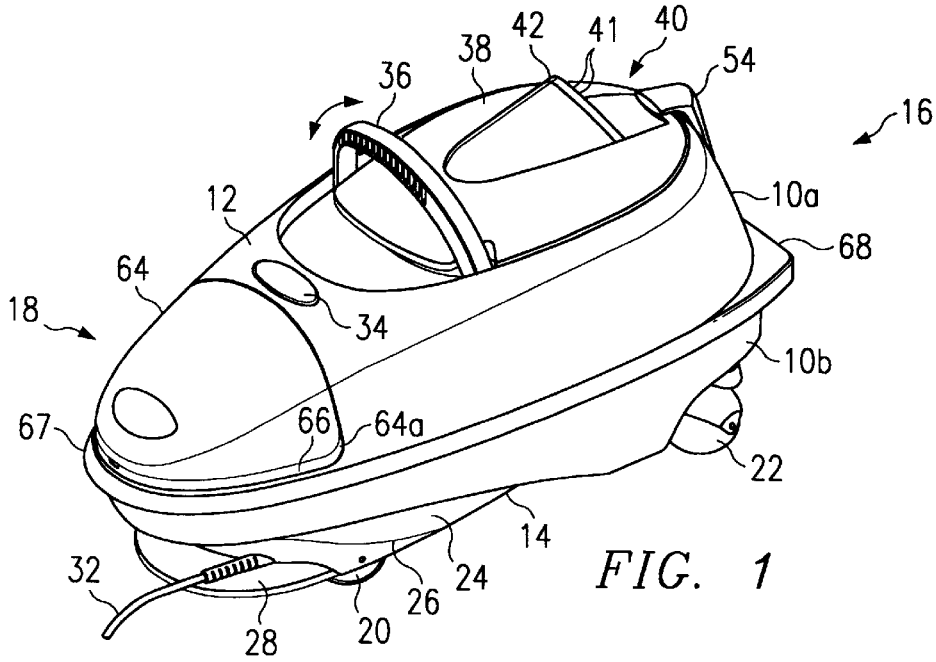
FIG. 1 is a perspective view of a tank-type vacuum cleaner of the present invention.

Preferred embodiments of the present invention will now be described in detail below with reference to the drawings.

Housing 10 is formed of cast aluminum or a suitable aluminum alloy with a top surface 12, a generally flat bottom surface 14, a forward portion 16, and a rear portion 18. As is evident from any of the figures, in cross-section, housing 10 is contoured in a manner in which forward portion 16 has a greater diameter-like dimension than rear portion 18.

Bottom surface 14 includes a pair of fixed wheels 20 and a pair of casters 22. In a preferred embodiment, wheels 20 and casters 22 are recessed relative to bottom surface 14. While the figures consistently depict the preferred embodiment, it should be appreciated, however, that wheels 20 and/or casters 22 may be replaced with skids (not shown).

Bottom surface 14 also includes cord wrap 24. Cord wrap 24 is comprised of an integral channel 26 formed into and recessed within housing 10. While channel 26 is illustrated as being formed in bottom surface 14, it should be appreciated that channel 26 may also be formed in side surfaces, end surfaces, and/or top surface 12.

Figure 4:
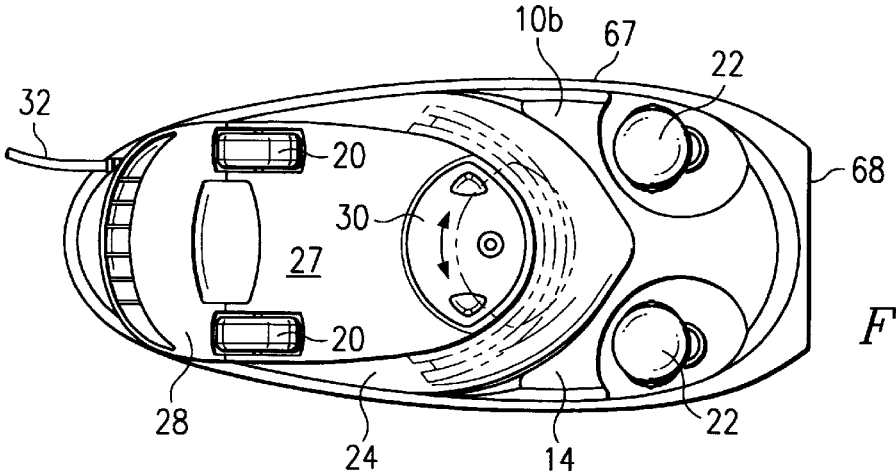
FIG. 4 is a bottom view of the vacuum cleaner of FIG. 1.

In a preferred embodiment, and in reference to FIG. 4, channel 26 continuously extends about a portion of bottom surface 14 and, in particular, circumscribes portion 27 of bottom surface 14. For the specific embodiment as illustrated, channel 26, at its rear-most portion, is defined by housing 10 as well as fixed channel portion 28. Channel portion 28 is preferably formed from nylon or a polypropylene and secured to housing 10 to form the rear portion of channel 26. Utilization of channel portion 28 reduces housing complexity for purposes of forming, e.g., casting. It should be understood by one having ordinary skill in the art that use of channel portion 28 is but one technique for completing channel 26, and that any variety of derivations of this technique are consistent with the present invention, for example, forming housing 10 of symmetric left and right portions (not shown), where channel 26 is formed by the joining of the two housing halves.

Returning to FIG. 4, rotatable retention element 30 is provided at or about the forward-most portion of channel 26. Retention element 30 is capable of assuming a first position (represented by the dotted outline of retention element 30), where the retention element 30 extends over at least a portion of channel 26. In a preferred embodiment, the first position requires retention element 30 to extend over channel 26 for a distance largely equal to one-half a width of channel 26. In a second position, retention element 30 is stored and does not extend over channel 26 in any significant proportion.

The specific dimensions of channel 26 are determined by the physical characteristics of cord 32, where such characteristics include at least a cord diameter and a cord length. Channel 26 should be formed to accommodate cord 32 having a total length from approximately one foot to at least 30 feet. In a preferred embodiment, the length of cord is approximately 18 feet. In a more preferred embodiment, the length of cord 32 is approximately 30 feet.

Operationally, retention element 30 is moved to the first position. Cord 32 is manually wound along channel 26, where channel portion 28 and retention element 30 act to retain cord 32 within channel 26. As should be noted, channel 26 enables cord 32 to be conveniently stored beneath the vacuum without the additional weight and/or height associated with conventional automatic cord winders. Moreover, cord 26 is discretely stored in a position that does not inconvenience its user during non-use nor detract from the unit's appearance.

When a user is ready to use the vacuum, some portion of cord 32 may be unwound, or retention member 30 may be repositioned to the second position, or even perhaps some intermediate position, to quickly release the entire length of wound cord 32.

While retention element 30 has been shown as a single element, retention element 30 may take the form of a plurality of rotatable retention elements 30 positioned at two or more positions along channel 26. As a further alternative, retention element 30 may take the form of one or more devices (not shown) which may be axially actuatable to extend over channel 26 in a manner effectively consistent with retention element 30 as shown in FIG. 4 and described here.

Top surface 12 of housing 10 includes at least power switch 34, handle 36, and pivoting inlet lid 38. Handle 36 is commonly stored in a lowered positioned within a recess defined by housing 10, for example, see FIG. 3. However, as it may be raised for use, handle 36 may also assume that position shown in FIG. 1.

Lid 38 includes an angularly disposed conduit inlet 40 which is capable of receiving a male connector portion of accessories, for example, a hose (not shown). Inlet 40 preferably includes at least two female electrical connectors 41 for connection with corresponding male electrical connectors (not shown) of an accessory, whereby the electrical connectors 41 supply power to any operatively coupled accessory.

Inlet 40 further includes insert 42. Insert 42 is a unitary body formed of thermoplastic rubber and is positioned within the interior of inlet 40. Insert 42 has a tapered bore which effectively creates a seal with an accessory male connector portion when such is properly positioned therein. Insert 42 further includes orifices which correspond to and are aligned with the at least two female electrical connectors of inlet 40, whereby insert 42 further insulates each female electrical connector from both an adjacent female connector and lid 38.

When inlet 40 has not fully received a male connector portion of an accessory, inlet 40 is preferably closed by flap 44. Flap 44 is positioned on the interior-side of inlet 40 and is biased toward inlet 40 by a biasing member 46. In the preferred embodiment, flap 44 is pivotally supported at point 45; however, flap 44 may be constructed to displace axially with respect to inlet 40. Upon inserting the male connector portion of an accessory into inlet 40 (and specifically, through insert 42), a distal end of the connector effects the displacement of flap 44.

While flap 44 is shown on an interior side of the inlet 40, it should be understood that flap 44, or a functional equivalent, may be positioned along the exterior surface of housing 10 to effect obstruction of inlet 40.

Lid 38 covers opening 47 which opens into the interior of housing 10. Opening 47 is effectively defined by surrounding annular flange 48. Annular flange 48 supports, for example, rim 50 of fabric bag 52 which acts as a filter as well as a collector for dust, debris, and the like. As fabric bag 52 is reusable, fabric bag 52 may receive a disposable bag (not shown) for actually collecting dust and other debris drawn in through inlet 40. An example of at least one embodiment of fabric bag 52 is set forth in U.S. Pat. No. 5,167,680, where such disclosure is incorporated by reference here.

When lid 38 is closed, rim 50 is compressed between lid 38 and annular flange 48 to provide an airtight seal. To effect such seal, rim 50 may include an annular rubber material which is compressed when lid 38 is closed, or alternatively, an annular rubber seal may be fixedly applied to the annular flange 48. Lid 38 may be secured in place using latch 54. In a preferred embodiment, a height added by the addition of fabric bag 52 above annular flange 48 is necessary to enable latch 54 to secure lid 38.

During operation, air is drawn through inlet 40 and bag 52 by motor assembly M. Motor assembly M includes at least a motor 56, which drives a coupled impeller assembly, and a protective screen 58. Motor 56 is received within an inner diameter 58*a* of protective screen 58.

In comparison, conventional vacuum motors are secured to their respective vacuum housings, and a protective guard (similar to that shown in FIG. 3) or the like is generally removable to allow human access, whether intentional or inadvertent, to the potentially dangerous impellers. For safety purposes, conventional systems require additional guards to prevent such access.

Figure 3:
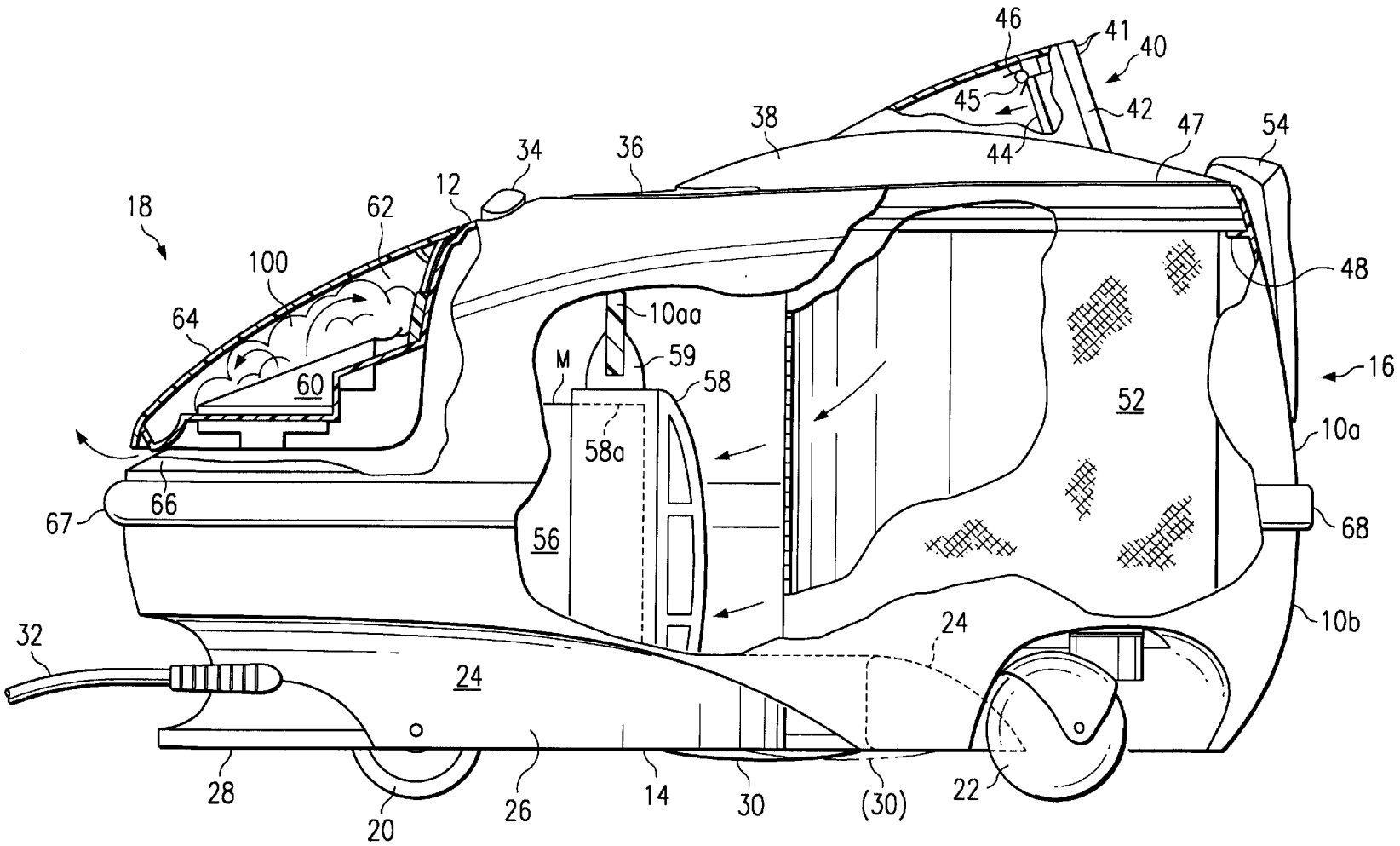
FIG. 3 is a partially sectional elevational view of the vacuum cleaner of FIG. 1.

In reference to FIG. 3, motor assembly M is secured between the two halves 10*a,* 10*b* of housing 10, and in one particular example, by structural members (e.g., 10*aa*) of the respective halves 10*a,* 10*b,* which respectively extend inwardly into the interior of each half 10*a,* 10*b*. An annular seal 59 is positioned between motor assembly M and housing 10. Halves 10*a,* 10*b* secure the entire motor assembly M, including protective screen 58, thereby preventing the need for additional safety devices.

In a preferred embodiment, protective screen 58 may include a removable filter (not shown) to prevent the introduction of potentially harmful debris into motor assembly M.

Air drawn through motor assembly M is forced through outlet 60 in rear portion 18. Outlet 60 is structurally consistent with inlet 40 (e.g., connectors 41 and the insert 42), thus, for example, when the cover 64 is removed, the outlet 60 can also receive the male connector portion of an accessory, for example, a hose (not shown) like that which is receivable by the inlet 40 (discussed hereinabove). In this configuration, the vacuum system of the present invention may be used as a blower.

Outlet 60 preferably receives a fine particulate filter 100 to filter that air passing therethrough and remove dust and fine particulates introduced into the air flow due to motor wear. In a preferred embodiment, the fine particulate filter is a conventional electrostatic balloon filter capable of filling chamber 62 defined by cover 64 (to be discussed further below) and housing 10 or a pleated-style filter. Accordingly, to optimize air flow, cover 64 includes one or more inwardly-directed protrusions to prevent the filter from forming a seal against cover 64 during operation and decreasing air flow. While using a balloon filter is preferred, one skilled in the art will recognize that a filter of any suitable material, or no filter, may be used in conjunction with outlet 60.

Cover 64 is removably coupled to housing 10, whereas cover 64 and housing 10 may define one or more openings 64*a* which allow communication between chamber 62 and the surrounding environment. Housing 10 may be formed with features, for example, cove 66, to direct air flow through the opening(s) between cover 64 and housing 10. With or without such air-directing enhancements, the relationship between cover 64 and housing 10 creates a baffle to diffuse and control (i.e., direct) the discharge of air from outlet 60.

As may be seen in reference to FIG. 3, outlet 60 is oriented perpendicular to a longitudinal direction of housing 10, thereby effectively directing the air flow (as discussed above) and its accompanying acoustic noise in a direction initially inconsistent with the opening(s) between cover 64 and housing 10. As a consequence of such control, cover 64 further muffles the acoustic noise output by the vacuum system.

As an alternative to or in cooperation with the above structural description, cover 64 may include one or more openings (not shown) formed therein. Further, chamber 62 may include acoustic noise-absorbing material, for example, foam, where such material may be attached to either cover 64 or housing 10.

Figure 2:
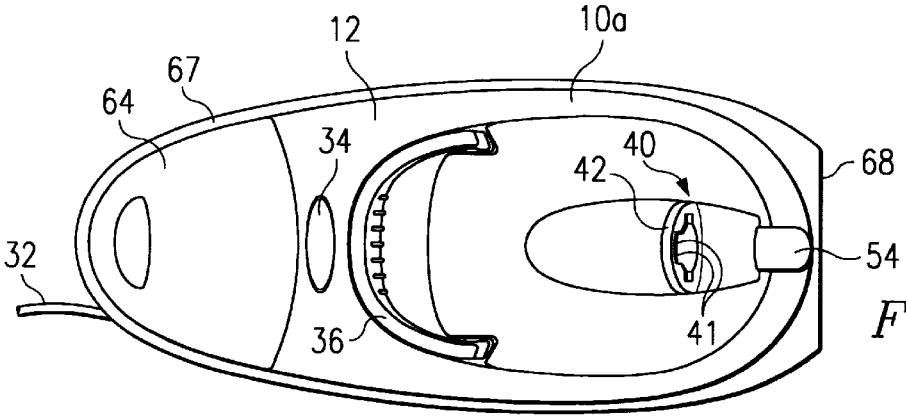
FIG. 2 is a plan view of the vacuum cleaner of FIG. 1.

As provided above, housing 10 is formed of upper housing 10*a* and lower housing 10*b*. To prevent air leakage from between housings 10*a,* 10*b,* seal 67 is positioned therebetween. Seal 67 is formed of a durable, flexible material that further provides a bumper surface to protect housing 10 as well as furniture and the like from damage during use. While preferably uniform in thickness about the perimeter of housing 10, seal 67 has a flat surface 68 at forward portion 16 (see FIG. 2).

Flat surface 68 and a forward-most surface of latch 54, which is substantially planar with flat surface 68 (see FIG. 3), allow the vacuum of the present invention to be placed on its forward end for convenient storage. In such a vertical orientation, flap 44, as discussed above, prevents dust and debris within fabric bag 52 from inadvertently being discharged from inlet 40.

While certain features of the present invention may be unique or better suited for tank-type vacuum cleaners, one skilled in the art may certainly appreciate their application to other vacuum cleaner systems.

While the invention has been described herein relative to a number of particularized embodiments, it is understood that modifications of, and alternatives to, these embodiments, such modifications and alternatives realizing the advantages and benefits of this invention, will be apparent those of ordinary skill in the art having reference to this specification and its drawings. It is contemplated that such modifications and alternatives are within the scope of this invention as subsequently claimed here, and it is intended that the scope of this invention claimed here be limited only by the broadest interpretation of the appended claims to which the inventors are legally entitled.

What is claimed is:

1. A vacuum cleaner comprising a housing including an inlet, an outlet, a power cord, a vacuum motor, a cord retaining device, and a particulate accumulation receptacle, wherein the vacuum motor, electrically coupled to the power cord, operatively draws air through the inlet for discharge through the outlet, where certain particulates within the air accumulate within the receptacle as the air passes therethrough, wherein the housing further includes a continuous power cord storage channel, recessed within a surface of the housing to receive the power cord for storage, and wherein the cord retaining device is moveably joined to the housing to selectively move from a first position, extending over at least a portion of the power cord storage channel, to at least a second position, substantially retracted from the power cord storage channel.

2. A vacuum cleaner in accordance with claim 1, wherein the power cord storage channel is recessed within a lower surface of the housing.

3. A vacuum cleaner in accordance with claim 1, wherein the cord retaining device is rotatable from the first position to at least the second position.

4. A vacuum cleaner in accordance with claim 1, further comprising means to allow the housing to be vertically positioned on an end surface.

5. A vacuum cleaner in accordance with claim 4, further comprising an automatic inlet closing device, which is movable and is biased to a position which obstructs the inlet.

6. A vacuum cleaner comprising:

a housing with an inlet, an outlet, and a power cord storage channel formed therein;

a cord retaining device;

a particulate accumulation receptacle, removably positioned within the housing and between the inlet and the outlet, to filter particulates from air passing therethrough; and a vacuum motor, positioned within the housing and between the outlet and the particulate accumulation receptacle, to draw air from the inlet, through the particulate accumulation receptacle, and to effect a discharge of such air through the outlet;

wherein the power cord storage channel circumscribes at least a portion of a surface of the housing, and wherein the cord retaining device is moveably joined to the housing to selectively move from a first position, extending over at least a portion of the power cord storage channel, to at least a second position, substantially retracted from the power cord storage channel.

7. A vacuum cleaner in accordance with claim 6, wherein the surface is a lower surface of the housing.

8. A vacuum cleaner in accordance with claim 5, wherein the cord retaining device is rotatable from the first position to at least the second position.

9. A vacuum cleaner in accordance with claim 6, further comprising a fine particulate filter, wherein the filter is coupled to the outlet.

10. A vacuum cleaner in accordance with claim 9, wherein the filter is a balloon filter.

11. A vacuum cleaner in accordance with claim 6, further comprising an exhaust cover which is removably attached to the housing, wherein when the exhaust cover is attached to the housing, a chamber is defined by the housing and an interior surface of the cover.

12. A vacuum cleaner in accordance with claim 11, wherein an opening is defined between the cover and the housing to permit air flow from the chamber to a surrounding environment.

13. A vacuum cleaner comprising:

a first housing portion;

a second housing portion to mate with the first housing portion, wherein mated first and second housing portions define a motor mount;

a motor having an impeller assembly; and a protective screen which engages the motor and covers the impeller assembly of the motor, wherein the first and second housing portions engage at least the protective screen to secure the protective screen and the engaged motor within the motor mount.

14. A vacuum cleaner in accordance with claim 13, further comprising a seal interposed between the first and second housing portions and the protective screen.

15. A vacuum cleaner comprising:

a housing, with an inlet and an outlet, having supporting members to support the housing and to readily facilitate movement of the vacuum cleaner;

a vacuum motor, positioned within the housing and between the inlet and the outlet, to draw air from the inlet and to discharge such air through the outlet; and an outlet cover, removably coupled to the housing and forming at least a portion of at least one of an upper surface or a side surface of the housing when the housing is resting on the support members, wherein when the outlet cover is coupled to the housing, an interior surface of the outlet cover cooperates with a portion of the housing to define a chamber, and the chamber is in communication with the outlet.

16. A vacuum cleaner in accordance with claim 15, wherein the outlet cover defines at least one opening, and the at least one opening enables air to pass from the chamber to a surrounding environment.

17. A vacuum cleaner in accordance with claim 16, wherein when the outlet cover is coupled to the housing, the at least one opening is defined by a space between the outlet cover and the housing.

18. A vacuum cleaner in accordance with claim 15, further comprising a filter which is removably coupled to the outlet.

19. A vacuum cleaner in accordance with claim 18, wherein the filter is a balloon filter.

20. A vacuum cleaner comprising:

a housing with an inlet and an outlet, having an axis of discharge, and including supporting members to support the housing and to readily facilitate movement of the vacuum cleaner;

a vacuum motor, positioned within the housing and between the inlet and the outlet, to draw air from the inlet and to discharge such air through the outlet; and a detachable extension of the housing, intersecting the axis of discharge and defining at least one opening between the housing and the detachable extension when the detachable extension is joined to the housing, to redirect air discharged from the outlet and muffle acoustic noise also output therefrom, wherein the detachable extension forms at least a portion of at least one of an upper surface or a side surface of the housing when the housing is resting on the support members.

21. A vacuum cleaner in accordance with claim 20, wherein the detachable extension defines a chamber between the housing and an interior surface of the detachable extension.

22. A vacuum cleaner in accordance with claim 21, further comprising a filter, positioned within the chamber so as to allow air discharged from the outlet to pass therethrough.

23. A vacuum cleaner in accordance with claim 20, wherein the outlet is positioned substantially perpendicular to an interior surface of the detachable extension.

24. A vacuum cleaner comprising:

a housing with an inlet, an outlet, and a power cord storage channel formed therein, wherein the housing is formed of a first housing portion mating with a second housing portion, the mated first and second housing portions defining a motor mount within an interior of the housing;

an inlet closing device to selectively obstruct the inlet;

a particulate accumulation receptacle, removably positioned within the housing and between the inlet and the outlet, to filter particulates from air passing therethrough;

a vacuum motor having an impeller assembly, positioned within the housing and between the outlet and the particulate accumulation receptacle, to draw air from the inlet, through the particulate accumulation receptacle, and to effect a discharge of such air through the outlet;

an impeller protection screen, which fixedly receives the vacuum motor and is directly engages by the motor mount; and a detachable outlet cover, substantially covering the outlet so as to establish at least one opening between the housing and the detachable extension when the detachable extension is joined to the housing, which defines a chamber between the housing and an interior surface of the cover, the chamber being in communication with the outlet, wherein the power cord storage channel is continuous and recessed within a surface of the housing to receive the power cord for storage.

* * * * *